US005388309A

United States Patent [19]

Grass

[11] Patent Number: 5,388,309

[45] Date of Patent: Feb. 14, 1995

[54] HINGE WITH ROTARY CUP

[75] Inventor: Alfred Grass, Hochst/Vlbg, Austria

[73] Assignee: Grass AG, Hochst/Vlbg, Austria

[21] Appl. No.: 115,873

[22] Filed: Sep. 1, 1993

[30] Foreign Application Priority Data

Sep. 21, 1992 [DE] Germany ..... 9212627[U]

[51] Int. Cl.[6] ..... E05D 5/00

[52] U.S. Cl. ..... 16/382; 16/272

[58] Field of Search ..... 16/272, 382, 383, 384

[56] References Cited

U.S. PATENT DOCUMENTS 5,195,214 3/1993 Lautenschlager et al. ..... 16/382

FOREIGN PATENT DOCUMENTS 328917 4/1976 Austria .
0487821 6/1992 European Pat. Off. .
2143572 3/1973 Germany .
3722950 1/1989 Germany .
4037752 7/1992 Germany .
9109862 9/1992 Germany .
1381965 1/1975 United Kingdom .
2257747 1/1993 United Kingdom .

*Primary Examiner*—P. Austin Bradley
*Assistant Examiner*—Chuck Y. Mah

[57] ABSTRACT

A hinge for insertion in a recess in a furniture portion (e.g. a door) including a press-in cup for engagement with the recess and rotary cup which is engageable with the press-in cup by a rotary action. Pairs of complementarily engageable tabs are provided on the bases of the cups. Further pairs of complementarily engageable engagement tabs are provided on side walls of the cups which provide a camming action tending to urge the cups together as they are engaged. The base of the press-in cup is provided with a resilient detent tongue which springs into place when the cups are connected and resists inadvertent disconnection. Manual depression of the detent permits the cups to be separated.

10 Claims, 3 Drawing Sheets

HINGE WITH ROTARY CUP

TECHNICAL FIELD

The invention relates to a hinge including a press-in cup adapted to be pressed into a recess in a furniture portion and a rotary cup which is adapted to connect the remainder of the hinge to the press-in cup by a rotary or bayonet engagement action.

While the recess is described below as being in a door it could equally be in a side or other part of a piece of furniture.

BACKGROUND ART

A hinge of the type described above is disclosed in Utility Model DE 91 09 862 U1, by the same applicant. The bayonet-type engagement between the press-in cup and the rotary cup is relatively effective. However, it has been shown that hinges which are subjected to great strain require an even better connection between the press-in cup and the rotary cup. In some cases it is also desirable to provide a safeguard against rotation, which, whilst allowing a bayonet-type lock between the press-in cup and the rotary cup, does not permit an unintentional release.

OBJECTS OF THE INVENTION

It is an object of the invention to provide a hinge of the type described above in which the rotary cup is more securely held in the press-in cup than in prior art hinges.

It is a further object of the invention to provide a safeguard against unintentional disengagement of the rotary cup and the press-in cup.

SUMMARY OF THE INVENTION

The foregoing objects are met in accordance with the invention by the provision of a hinge including a press-in cup having a base and a side wall for engagement in a recess in a furniture portion, a rotary cup having a base and a side wall for engagement with the press-in cup, primary engagement means for interconnecting the cups upon relative rotation, secondary engagement means for interconnecting the cups upon relative rotation, locking means for restraining movement between the cups, wherein the primary engagement means comprises co-operating parts of the base of each cup, the secondary engagement means includes engagement members which project radially inwardly from the side wall of the press-in cup and the locking means comprises a detent projecting from the base of the press-in cup and is engageable with the side wall of the rotary cup.

The provision of the secondary engagement means makes it possible to achieve an even stronger connection between the press-in cup and the rotary cup. The detent locking means prevents unintentional release of the bayonet-engagement between the two cups. A manual release is simply and easily achieved by appropriate operation of the detent.

The co-operating parts of the primary engagement means preferably comprise first tabs on the base of the rotary cup which engage corresponding second tabs bent from the base of the press-in cup.

The secondary engagement means preferably includes third tabs connected to the rotary cup which are engageable with the engagement members projecting radially inwardly from the side wall of the press-in cup.

In order that the cups are held tightly together when they are engaged the secondary engagement means preferably includes camming surfaces configured to urge the rotary cup into the press-in cup as the two cups are engaged.

Conveniently the engagement members in the wall of the press-in cup are in the form of tabs bent at approximately 90°, the free ends of which are substantially parallel to the base of the press-in cup.

In order to effect automatic engagement of the detent locking means whilst permitting easy deactuation of its locking effect the detent is preferably resilient and punched by means of a U-shaped cut-out from the base of the press-in cup.

The detent, which may be in the form of a tongue, is punched out of the base area of the press-in cup, bent slightly inside the press-in cup and is initially pressed flat as the rotary cup is inserted or screwed in. In the final inserted position, the detent springs into a free space of the rotary cup and an end of the detent engages one of the inner walls of the rotary cup thereby preventing inadvertent rotation of the rotary cup.

The detent is released simply by pressing down the detent with a finger (through the free interior space of the rotary cup) and at the same time rotating the rotary cup in the opening direction.

Further important features and advantages of the invention will become obvious from the accompanying drawings and the description thereof.

BRIEF DESCRIPTION OF THE DRAWINGS

A detailed description of an embodiment of the invention follows which refers to the accompanying figures which show.

DETAILED DESCRIPTION

For the operation of the hinge, attention is drawn to U.S. Pat. No. 5,239,730, corresponding to German Utility Model G 91 09 862, the disclosure of which is incorporated herein by reference.

Figure 1:
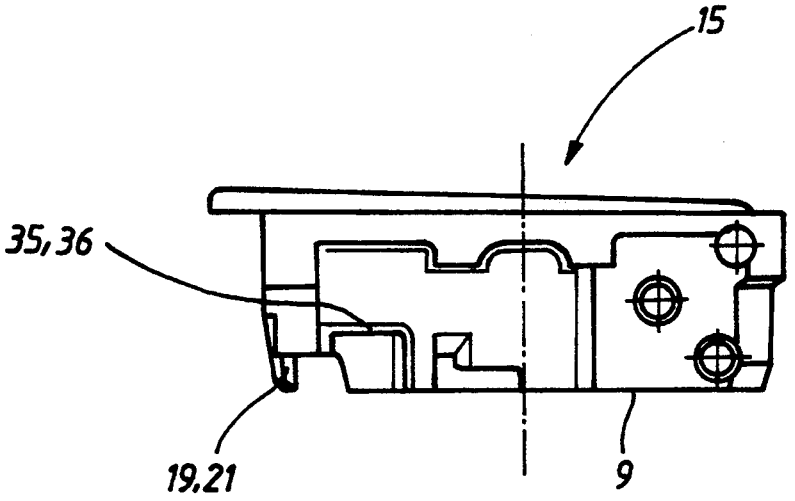
FIG. 1: a side view of a rotary cup of a hinge according to the invention.
Figure 2:
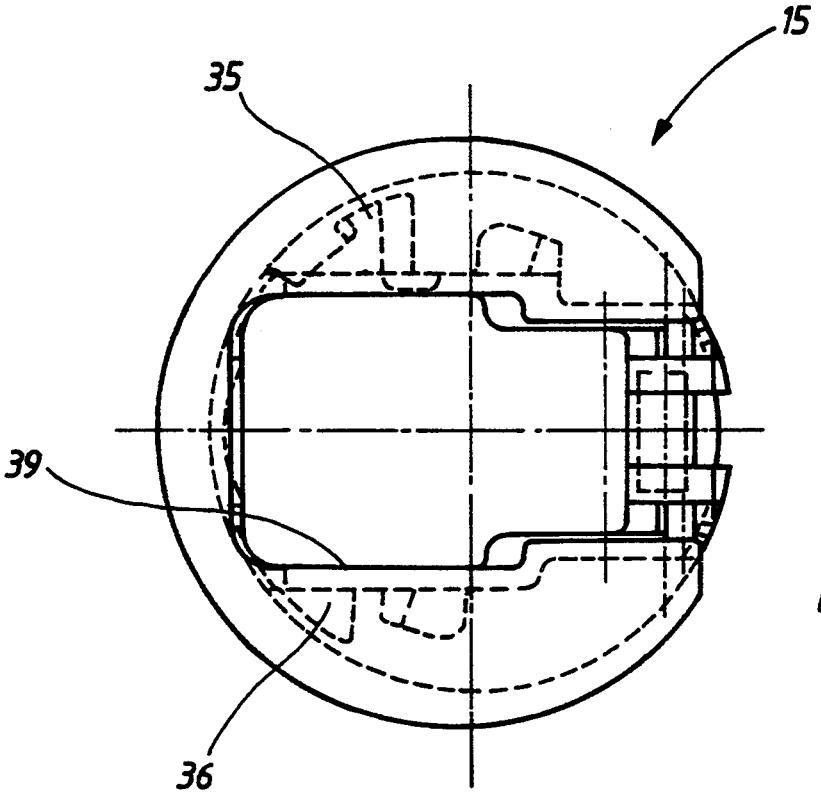
FIG. 2: a plan view of the rotary cup shown in FIG. 1.

The rotary cup 15 shown in FIGS. 1 and 2 has a base 9 and side wall 39 surrounding a space for accommodating other hinge components which are shown in outline. The side wall of the rotary cup 15 has tabs 35, 36 (third tabs) bent to point in the circumferential direction, which project radially outwards from the side wall 39°. The base of the rotary cup has tabs 19, 21 (second tabs).

In a manner known per se the hinge arm, which is not shown in detail, is pivoted into the rotary cup 15 when the hinge is in the closed position. The rotary cup 15 also has an upper peripheral edge by which it is supported in the press-in cup 10 recessed in a door.

Figure 3:
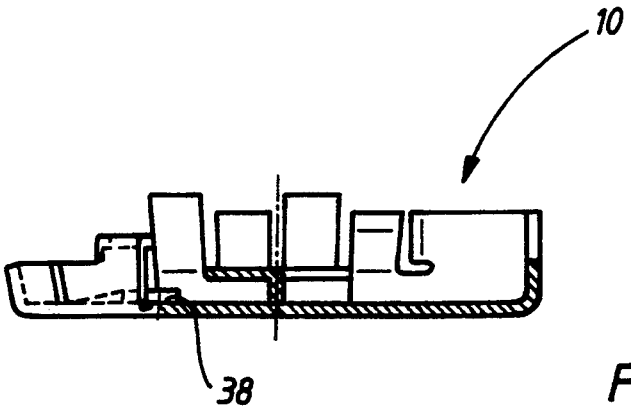
FIG. 3: a partial section through a press-in cup of a hinge according to the invention.
Figure 4:
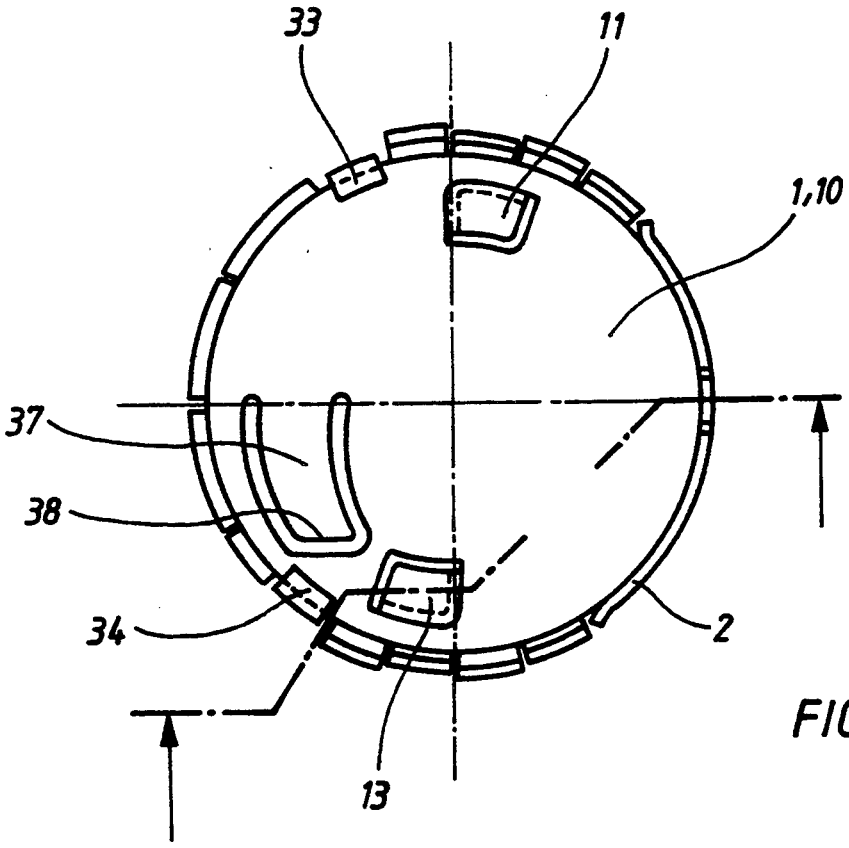
FIG. 4: a plan view of the press-in cup shown in FIG. 3, FIG. 5: a side view of an assembled hinge including a press-in cup and rotary cup, in which the press-in cup is partly cut-away.
Figure 5:
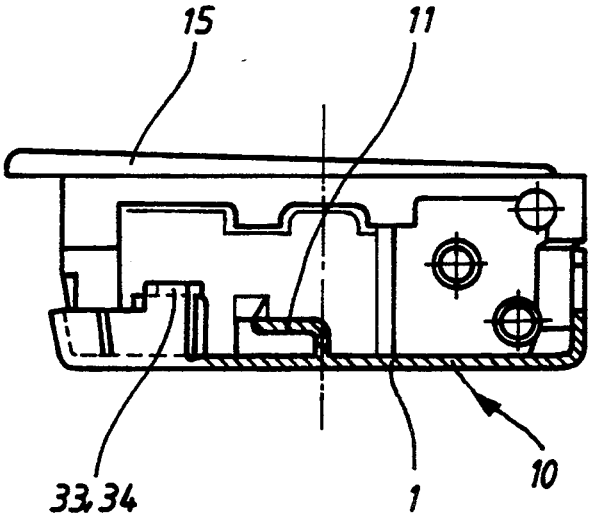
Figure 6:
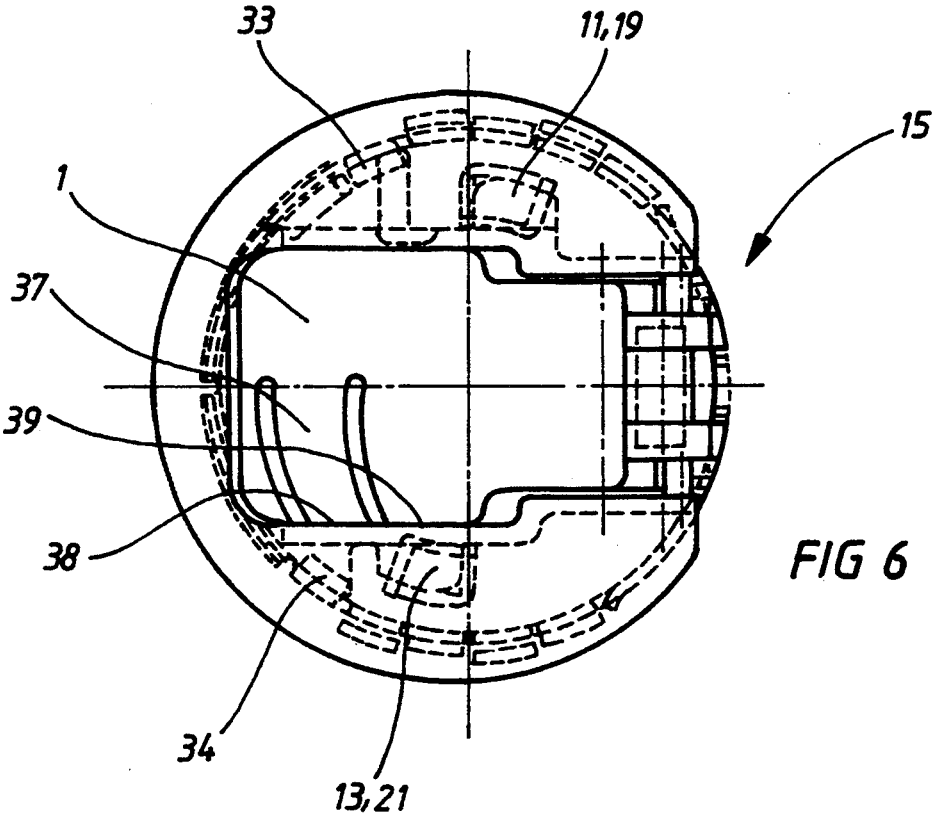
FIG. 6: a plan view of the hinge shown in FIG. 5.

The press-in cup, shown in FIGS. 3 and 4, has a base 1 and a side wall 2. Apart from the known angular bent tab portions 11, 13 (first tabs), which are bent away from the bottom surface 1, the press-in cup 10 has further angular bent engagement members 33, 34 which are bent away from the side wall 2 and are directed radially inwardly.

During the bayonet locking engagement of the rotary cup 15 in the press-in cup 10, the second tabs 19, 21 arranged on the base 9 of the rotary cup, initially engage beneath corresponding first tabs 11, 13 in the base of the press-in cup. This constitutes the primary engagement means.

At the same time that the primary engagement means is engaged the third tabs 35, 36 on the side wall of the rotary cup engage beneath inclined camming surfaces of the engagement members 33, 34 on the side wall of the press-in cup. This constitutes the secondary engagement means.

The fact that one of the bayonet-like connections is positioned on the bottom surfaces of the two cups and the other bayonet-like lock is situated above the bottom surfaces leads to a double locking effect. Each engagement member 33, 34 in the wall of the press-in cup is situated close to a first tab 11, 13 in the base of the press-in cup.

When the hinge is to be installed, the press-in cup is first inserted into a recess in a door. For locking the said cups together, the rotary cup 15 is rotated counterclockwise in the press-in cup 10. The rotary cup is rotated until the end face 38 of a resilient detent tongue 37 which projects slightly upwards from the base 1 of the press-in cup 10 is overrun by the side wall 39 of the rotary cup 15. The detent 37 then springs up past the side wall (inner wall) 39 of the rotary cup 15. The end face 38 of the detent tongue 37 rests against the side wall 39 of the rotary cup 15 which is thus safeguarded against an unintentional disconnection from the press-in cup 10 (clockwise rotation) .

If the double bayonet-like lock is to be released, pressure by hand is exerted on the detent tongue 37, so that its end face 38 becomes approximately flush with the bottom face 1 of the press-in cup 10. The rotary cup 15 can then be rotated clockwise in the press-in cup 10, thus releasing the double bayonet-type lock.

With this description of the invention in detail those skilled in the art will appreciate that modifications may be made to the invention without departing from the spirit thereof. Therefore it is not intended that the scope of the invention be limited to the specific embodiments. Rather it is intended that the scope of the invention be determined by the scope of the appended claims, The present invention should also be considered as extending to any novel combination of claims or features disclosed in the specification or abstract.

I claim:

1. Hinge comprising:

a press-in cup having a base and a side wall for engagement in a recess in a furniture portion, a rotary cup having a base and a side wall for engagement with the press-in cup, primary engagement means for interconnecting the cups upon relative rotation, secondary engagement means for interconnecting the cups upon relative rotation, locking means for restraining movement between the cups, wherein the primary engagement means comprises co-operating parts of the base of each cup, the secondary engagement means includes engagement members which project radially inwardly from the side wall of the press-in cup and the locking means comprises a detent projecting from the base of the press-in cup and is engageable with the side wall of the rotary cup.

2. Hinge according to claim 1 wherein the rotary cup engages the press-in cup by a bayonet type engaging action.

3. Hinge according to claim 1 wherein the co-operating parts of the primary engagement means comprise first tabs on the base of the rotary cup and corresponding second tabs bent from the base of the press-in cup with which the first tabs engage.

4. Hinge according to claim 3 wherein the secondary engagement means includes third tabs connected to the rotary cup which are engageable with the engagement members projecting radially inwardly from the side wall of the press-in cup.

5. Hinge as claimed in claim 4 wherein the first tabs are adjacent the engagement members in the press-in cup.

6. Hinge according to claim 1 wherein the engagement members in the side wall of the press-in cup are in the form of tabs bent at approximately 90°, the free ends of which are substantially parallel to the base of the press-in cup.

7. Hinge according to claim 6 wherein the secondary engaging means includes tabs which are arranged on the outside of the rotary cup in the area of its side wall and engage beneath the engagement members of the press-in cup

8. Hinge according to claim 1 wherein the detent is resilient and punched by means of a U-shaped cut-out from the base of the press-in cup.

9. Hinge according to claim 1 wherein the detent is positioned substantially parallel to the circumferential direction of the side wall of the press-in cup.

10. Hinge according to claim 1 wherein the secondary engagement means includes camming surfaces configured to urge the rotary cup into the press-in cup as the two cups are engaged.

* * * * *